US011639836B2

(12) United States Patent
Avery

(10) Patent No.: US 11,639,836 B2
(45) **Date of Patent: *May 2, 2023**

(54) ARCHERY TRAINING DEVICE

(71) Applicant: David B Avery, Kailua Kona, HI (US)

(72) Inventor: David B Avery, Kailua Kona, HI (US)

( * ) Notice: Subject to any disclaimer, the term of this patent is extended or adjusted under 35 U.S.C. 154(b) by 238 days.

This patent is subject to a terminal disclaimer.

(21) Appl. No.: 16/997,916

(22) Filed: Aug. 19, 2020

(65) Prior Publication Data

US 2021/0302120 A1 Sep. 30, 2021

Related U.S. Application Data

(60) Provisional application No. 62/994,788, filed on Mar. 25, 2020.

(51) Int. Cl.

| | |
|---|---|
| ***F41B 5/14*** | (2006.01) |
| ***A63B 21/02*** | (2006.01) |
| *A63B 21/00* | (2006.01) |
| *A63B 21/055* | (2006.01) |
| *A63B 21/04* | (2006.01) |

(52) U.S. Cl.

CPC ..... *F41B 5/1476* (2013.01); *A63B 21/00185* (2013.01); *A63B 21/0442* (2013.01); *A63B 21/0552* (2013.01); *A63B 21/4035* (2015.10)

(58) Field of Classification Search

CPC ..... A63B 21/00185; A63B 21/0442; A63B 21/0552; A63B 21/04035; A63B 21/04021; A63B 2244/04; A63B 21/4035; A63B 21/4021; F41B 5/1476; F41B 3/02

USPC ..... 124/17, 20.1

See application file for complete search history.

(56) References Cited

U.S. PATENT DOCUMENTS

| | | | | |
|---|---|---|---|---|
| 4,279,601 | A * | 7/1981 | Cobelli | A63B 69/00 482/122 |
| 4,609,191 | A * | 9/1986 | Remme | A63B 21/0552 482/122 |
| 5,163,413 | A * | 11/1992 | Carella | F41B 5/1476 124/90 |
| 5,592,928 | A * | 1/1997 | Frasier | F41B 5/1476 482/122 |
| 7,708,674 | B1 * | 5/2010 | Saunders | F41B 5/1476 482/122 |
| 11,236,965 | B1 * | 2/2022 | Tafoya | A63B 21/153 |
| 2008/0295816 | A1 * | 12/2008 | Edwards | F41B 3/02 124/20.3 |
| 2011/0028288 | A1 * | 2/2011 | Anderson | A63B 21/0552 482/121 |

(Continued)

FOREIGN PATENT DOCUMENTS

| | | | | |
|---|---|---|---|---|
| EP | 2664235 | * 11/2013 | | F41B 3/02 |

*Primary Examiner* — John E Simms, Jr.
(74) *Attorney, Agent, or Firm* — Michael D. Vrbanac

(57) ABSTRACT

Embodiments herein describe an archery training device for improving shooting accuracy. The device has a rigid body graspable by one hand, an elastic section for providing resistance, and a string coupled to the elastic section with a loop on the opposite end for receiving an archery release. The device further includes a sight pin on the rigid body for sighting while pulling on the string via an opposite distal hand to the hand grasping the rigid body. The device further includes an adjustable string length and adjustable resistance to match a particular configuration of a bow for a particular sporting enthusiast or hunter.

14 Claims, 3 Drawing Sheets

(56) References Cited

U.S. PATENT DOCUMENTS

2015/0300769 A1* 10/2015 Heisser ..... F41B 5/1476
408/1 R

* cited by examiner

ARCHERY TRAINING DEVICE

CROSS REFERENCE TO RELATED APPLICATIONS

This application hereby claims priority to U.S. provisional patent application No. 62/994,788, file Mar. 25, 2020.

TECHNICAL FIELD

Embodiments herein relate to the field of archery and, more specifically, to an archery training device having a sight, an adjustable draw resistance, and an adjustable draw length.

BACKGROUND

Generally, people shooting a bow and arrow for sport or hunting desire to shoot accurately, which generally means hitting the intended target at an intended location. For sport, a higher level of accuracy provides a higher score relative to competitors. For hunting, higher accuracy is desirable to improve hunting success. Improving accuracy of shooting in archery generally may require practicing with a bow and arrow at an archery range and further may include shooting during hunting. Prior to shooting, there may be a need for some type of physical warm up of the muscle groups involved in drawing a bow. Without a warmup, accuracy of shots may not be as desired. Generally, a person may perform selected exercises and/or stretches prior to shooting. Ideally, however, exercises that target the muscles used for shooting may be more desirable than general exercises. Additionally, exercises that further include sighting may be more desirable than general exercises and further may minimize target panic. Accordingly, a training device targeting muscles use in archery may provide improved shooting accuracy and furthermore may provide an opportunity to train such muscles when not at a shooting range or out in the field, thereby improving archery skills.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

In the following detailed description, reference is made to the accompanying drawings which form a part hereof, and in which are shown by way of illustrating embodiments that may be practiced. Other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. These terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Figure 1:
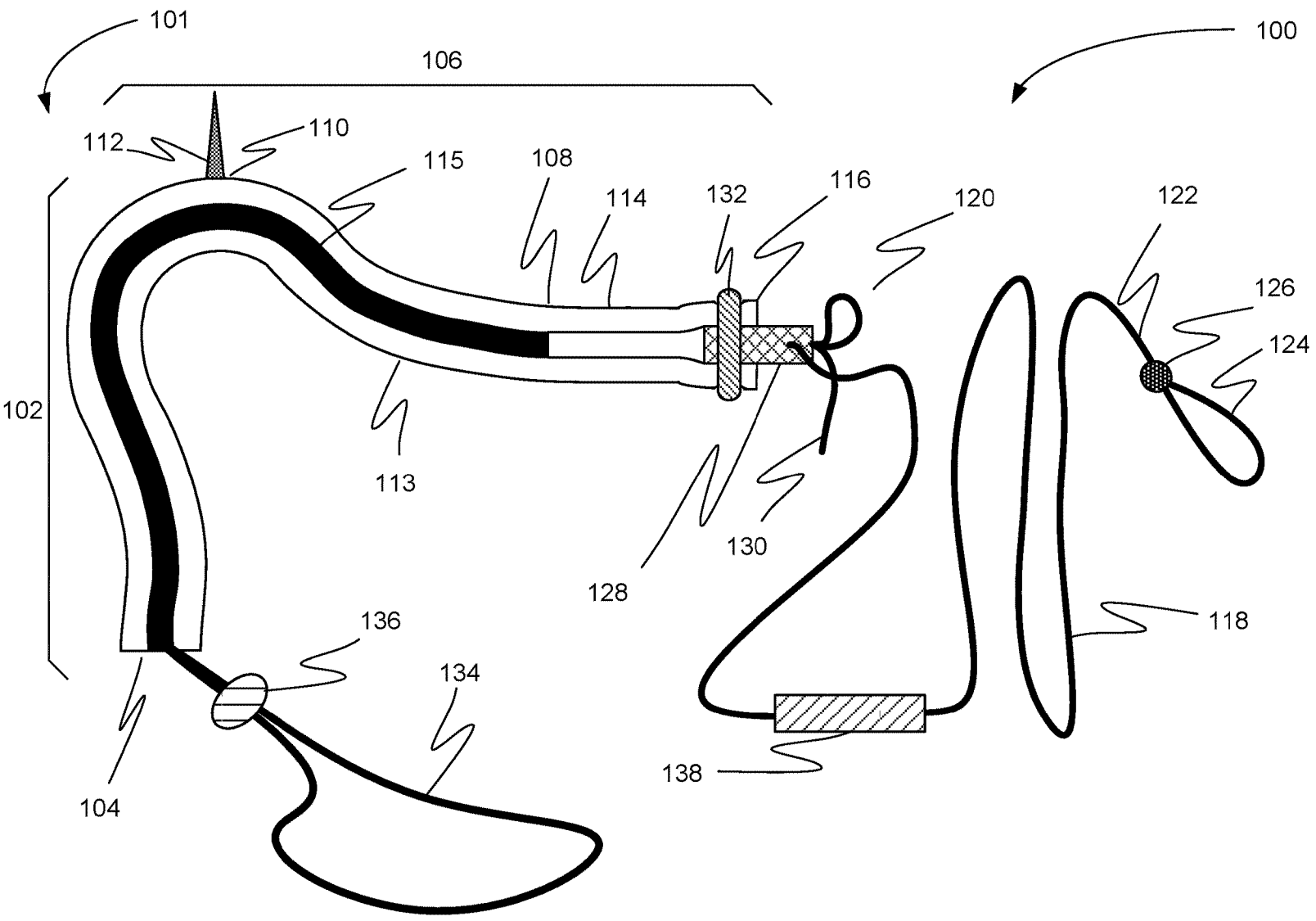
FIG. 1 schematically illustrates a view of an archery training device, in accordance with some embodiments.

FIG. 1 schematically illustrates a view of an archery training device 100, in accordance with some embodiments. In some embodiments, the archery training device 100 may include a rigid handle 101 comprised of a first region 102 so dimensioned to fit in a hand between a thumb and an index finger and to be grippable by the hand. The first region 102 may have a first end 104 locatable towards a small metacarpal of the hand when the first region 102 is held vertical by the hand. The device further may include a second region 106 extending from the first region 102. The second region 106 may be so dimensioned to traverse along the hand between a thumb metacarpal and an index metacarpal of the hand toward a wrist of the hand and may have a second end 108 locatable towards the wrist and below a high point 110 of the second region 106 when the first region 102 is held vertical by the hand. A person having ordinary skill in the art will readily understand and appreciate that the archery training device dimensions are selected to provide a relatively comfortable placement of the device in the hand of a person. By way of example and not limitation, an effective diameter of the device may be smaller than what may be reasonably held or gripped by a hand of a person. Similarly, an effective diameter of the device may be larger than a lower limit where the device diameter may be so small as to cause discomfort when the string 118 is drawn by a person thus placing the device tightly against the palm area of a hand. The device further may have the first end 104 extending below the small metacarpal of the hand. This extension below the hand may occur by design or may result from a person having relatively smaller hands. By way of example and not limitation, the effective diameter may be between about a half inch to about an inch. By way of example and not limitation, the first region 102 may have a curvilinear flat section having a width on the order of about a half inch to about an inch. A person having ordinary skill in the art will readily understand and appreciate that the dimensions of the device are selected to provide a person with a relatively comfortable user experience when the device is used, especially repeatedly used to improve archery skills.

The device further may include a sight pin 112 coupled to the second region 106 proximate to the high point 110 and oriented vertically away from the second region 106. The device further may include an elastic section 114 coupled to the second end 108 of the second region 106 and having an elastic end 116. The device further may include a string 118 having a first string end 120 coupled to the elastic end 116 of the elastic section 114 and having a second string end 122 coupled to a loop 124 so dimensioned for coupling to an archery release. The string 118 may be so dimensioned in length to be drawable by an opposite distal hand grasping the archery release when coupled to the loop 124 and when the first region 102 is held by the hand, thereby the elastic section 114 is placeable in tension. In some embodiments, the elastic section 114 and the string 118 may be customizable to an individual archer's needs. The rigid handle 101 comprised of first 102 and second 106 regions may be a curvilinear shape formed of a rigid material. The curvilinear shape may be ergonomic by design allowing a hand to comfortably hold the device. The curvilinear shape may include the high point 110 to allow clearance of a thumb metacarpal region of a hand and further to provide a mechanical pivot region to translate tension on end 108 to result in the first region 102 being pulled against a palm region of a hand when the device 100 is being used as intended.

In some embodiments, the cross section of the rigid handle 101 may be oval or circular such that the rigid handle 101 may be comfortably held in the palm of a hand. In some embodiments, the rigid handle 101 may have a cross section that is not oval or circular. For example, the rigid handle 101 may be formed from sheet metal by a stamping or cutting process followed by a bending and shaping process to form the rigid handle 101. The sheet metal may be convex in shape towards the palm of a hand when the rigid handle is held as it would be for its intended use. The rigid handle 101 may be formed by other processes such as casting or forging a metal into a suitable shape. In some embodiments, the rigid handle 101 may be formed from a plastic material such as a crosslinked or non-crosslinked polymer. The forming using a plastic material may be molding process. In some embodiments, the rigid handle 101 may be formed of a polymeric composite material by layup and curing of the material. In some embodiments, the rigid handle 101 may be comprised of a metal, a plastic, or a composite and further may be comprised of various combinations of metal, plastic or composite materials. In some embodiments, the rigid handle 101 may be comprised of an aluminum alloy. In some embodiments, the aluminum alloy may be a bendable rod. For example, the aluminum alloy may be a 6000 series aluminum rod. In some embodiments, the rod may be about ¼ to ½ inches in diameter. In some embodiments, the rod may be about ⅜ inches in diameter. In some embodiments, the rod may be a 6061 aluminum alloy about ⅜ inches in diameter.

In some embodiments, the elastic section 114 may be a portion of a hollow elastic tube 113 extending from the first end 104 of the first region 102 and past the second end 108 of the second region 106 to the elastic end 116, wherein the hollow elastic tube 113 covers the rigid handle 101, wherein the rigid handle is thereby comprised of a rigid core 115 inside of the hollow elastic tube 113. In some embodiments, the hollow elastic tube 113 may be an elastomer, a natural rubber, a synthetic rubber, or a silicone elastomer.

In some embodiments, the second end 108 of the second region 106 further may include a low friction material coupled to the second end 108, wherein friction between a contact region of the elastic section 114 and the second end 108 is reduced. In some embodiments, the low friction material may be a dry lubricant, a wet lubricant, a synthetic lubricant, a petroleum lubricant, a natural wax, a synthetic wax, a silicon spray lubricant, or a low friction polymeric material. In some embodiments, the low friction polymeric material may include polytetrafluorethylene.

In some embodiments, the elastic end 116 may have a rigid coupler 128 attached to the elastic end 116 and the first string end 120 of the string 118 may be coupled to the rigid coupler 128, wherein the rigid coupler 128 may have a hole for attachment of the string 118, whereby a length of the string extending past the rigid coupler to the loop 124 may be adjustable. A fastening device 132 may be used to couple the rigid coupler 128 to the elastic end 116. In some embodiments, the string may have a momentum decelerator 138 slidably coupled to the string 118, whereby the momentum decelerator 138 may be slidable along the string 118. In some embodiments, the elastic section 114 may be approximately 2.5 inches in length. In some embodiments, the fastening device may be an 80 lb Dacron graded fishing line.

In some embodiments, a retention loop 134 may be coupled to the first end 104 of the first region 102, wherein the retention loop 134 may be so dimension to fit around the wrist of the hand, whereby the retention loop 134 allows the device 100 to be securable to the wrist of the hand. In some embodiments, an adjustment device 136 may be slidably coupled to the retention loop 134 to allow adjustment of the size of the retention loop 134, whereby the retention loop size may be adjustable to the wrist of the hand.

Figure 2:
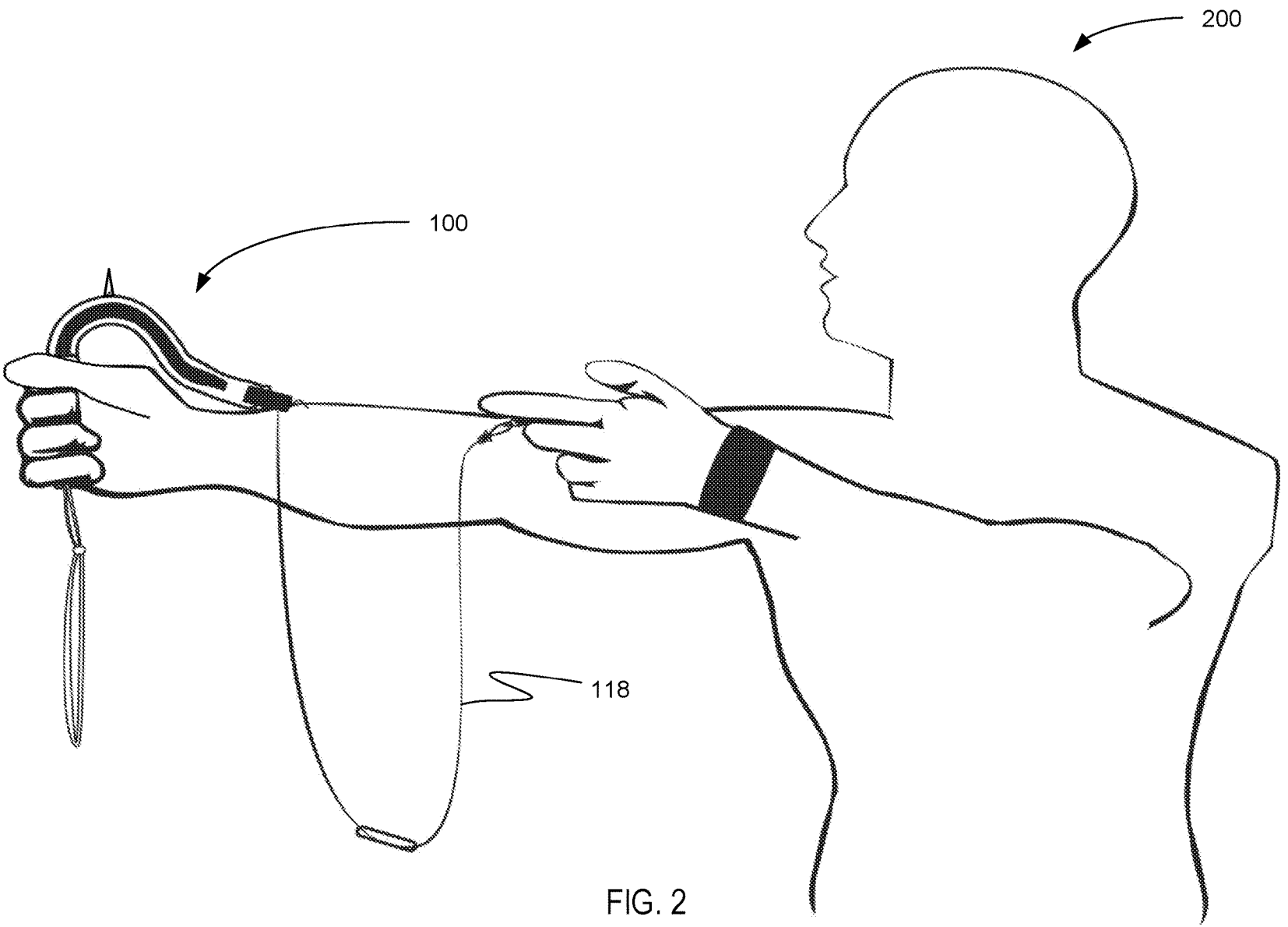
FIG. 2 schematically illustrates a view of an archery training device being held prior to draw, in accordance with some embodiments.

FIG. 2 schematically illustrates a view of the device 100 of FIG. 1 being held by a person 200 prior to drawing the device 100. The device 100 is being held by a left hand while the right hand is holding a release device coupled to the loop 124. The string 118 is shown in FIG. 2 in a relaxed state. To be clear, the string 118 is not under an external load exerted by person 200.

Figure 3:
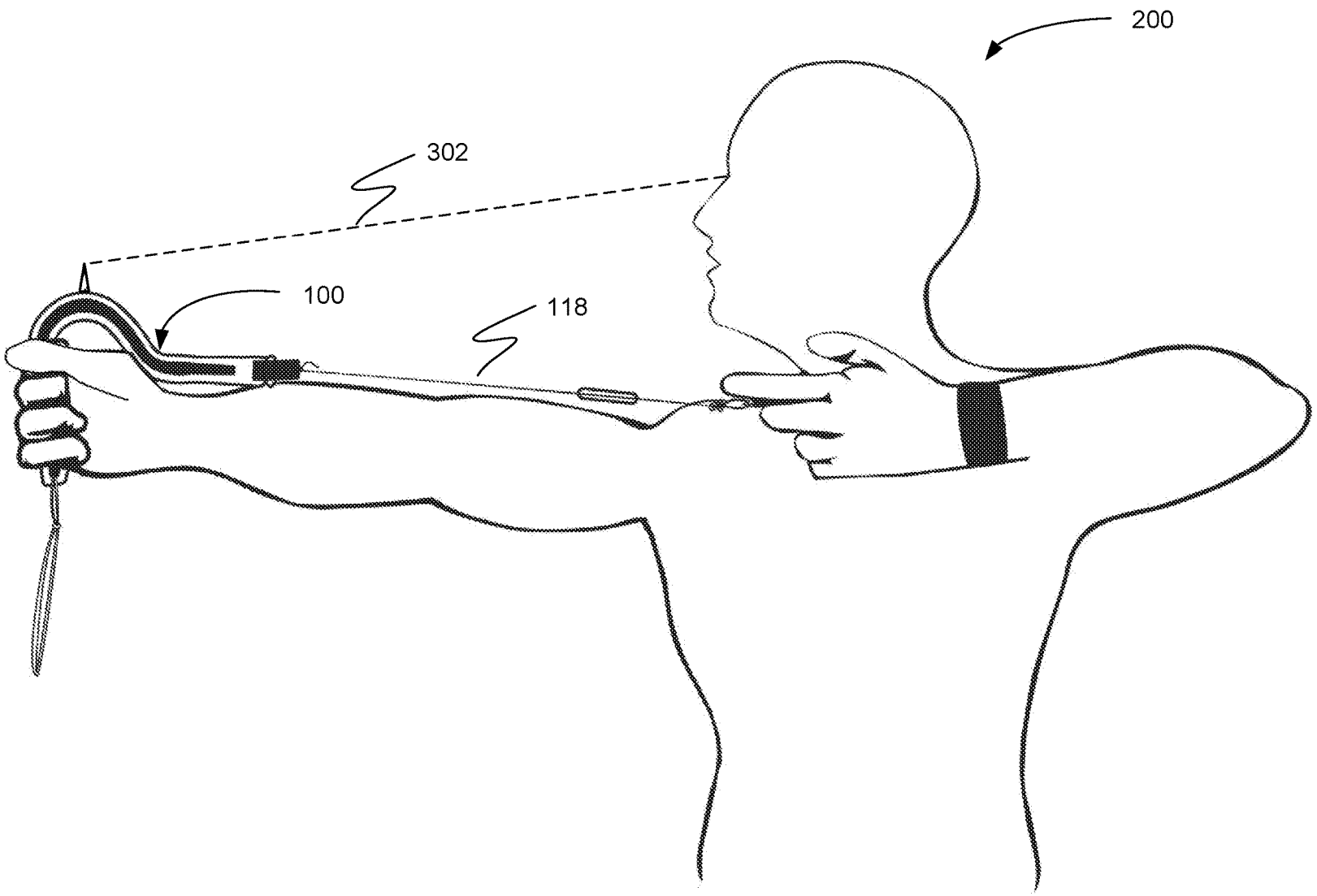
FIG. 3 schematically illustrates a view of an archery training device being held while being drawn, in accordance with some embodiments.

FIG. 3 schematically illustrates a view of the device 100 of FIG. 1 being held by the person 200 during draw of the device 100. The device 100 is being held by a left hand while the right hand is holding a release device coupled to the loop 124. The string 118 is shown in FIG. 2 in a state of tension imposed by person 200. To be clear, the string 118 is under an external load exerted by person 200. The person 200 may have a line of sight 302 to a target (not shown) extending from an eye of the person 200 through the sight 112 to the target. The person 200 may release the loop 124 using the archery release and repeat as many times as desired. The elastic section 114 may be selected to have a tension corresponding to a desired tension approximating a bow of the person 200. To be clear, the draw resistance of the elastic section 114 may be adjustable in order to match the draw resistance of the bow of the person 200.

EXAMPLES

According to various embodiments, the present disclosure describes an archery training device having a sight, an adjustable draw, and an adjustable tension.

Example 1 of an archery training device may include a rigid handle comprised of a first region so dimensioned to fit in a hand between a thumb and an index finger and to be grippable by the hand. The first region may have a first end locatable towards a small metacarpal of the hand when the first region is held vertical by the hand. The device further may include a second region extending from the first region. The second region may be so dimensioned to traverse along the hand between a thumb metacarpal and an index metacarpal of the hand toward a wrist of the hand and may have a second end locatable towards the wrist and below a high point of the second region when the first region is held vertical by the hand. The device further may include a sight pin coupled to the second region proximate to the high point and oriented vertically away from the second region. The device further may include an elastic section coupled to the second end of the second region and having an elastic end. The device further may include a string having a first string end coupled to the elastic end of the elastic section and having a second string end coupled to a loop so dimensioned for coupling to an archery release. The string may be so dimensioned in length to be drawable by an opposite distal hand grasping the archery release when coupled to the loop and when the first region is held by the hand, thereby the elastic section is placeable in tension.

Example 2 may include the archery training device of Example 1, wherein the rigid handle may be comprised of a metal, a plastic, or a composite.

Example 3 may include the archery training device of Example 2, wherein the rigid handle may be comprised of an aluminum alloy.

Example 4 may include the archery training device of Example 3, wherein the aluminum alloy may be a bendable rod.

Example 5 may include the archery training devices of Examples 1 through 4, wherein the elastic section may be a portion of a hollow elastic tube extending from the first end of the first region and past the second end of the second region to the elastic end, wherein the hollow elastic tube covers the rigid handle.

Example 6 may include the archery training device of Example 5, wherein the hollow elastic tube may be an elastomer, a natural rubber, a synthetic rubber, or a silicone elastomer.

Example 7 may include the archery training devices of Examples 1-6, wherein the second end of the second region further may include a low friction material coupled to the second end, wherein friction between a contact region of the elastic section and the second end is reduced.

Example 8 may include the archery training device of Example 7, wherein the low friction material may be a dry lubricant, a wet lubricant, a synthetic lubricant, a petroleum lubricant, a natural wax, a synthetic wax, a silicon spray lubricant, or a low friction polymeric material.

Example 9 may include the archery training device of Example 8, wherein the low friction polymeric material may include polytetrafluorethylene.

Example 10 may include the archery training devices of Examples 1-9, wherein the elastic end may have a rigid coupler attached to the elastic end and the first string end of the string may be coupled to the rigid coupler, wherein the rigid coupler may have a hole for attachment of the string, whereby a length of the string extending past the rigid coupler to the loop may be adjustable.

Example 11 may include the archery training devices of Examples 1-10, wherein the string may have a momentum decelerator slidably coupled to the string, whereby the momentum decelerator may be slidable along the string.

Example 12 may include the archery training devices of Examples 1-11, wherein a retention loop may be coupled to the first end of the first region, wherein the retention loop may be so dimension to fit around the wrist of the hand, whereby the retention loop allows the device to be securable to the wrist of the hand.

Example 13 may include the archery training device of Example 12, wherein an adjustment device may be slidably coupled to the retention loop to allow adjustment of the size of the retention loop, whereby the retention loop size may be adjustable to the wrist of the hand.

Example 14 of an archery training device may include a rigid handle comprised of an ergonomically shaped bendable aluminum alloy rod and is further comprised of a first region so dimensioned to fit in a hand between a thumb and an index finger and to be grippable by the hand, wherein the first region has a first end locatable towards a small metacarpal of the hand when the first region is held vertical by the hand, wherein a retention loop is coupled to the first end of the first region, wherein the retention loop is so dimension to fit around the wrist of the hand, whereby the retention loop allows the device to be securable to the wrist of the hand, wherein an adjustment device is slidably coupled to the retention loop to allow adjustment of the size of the retention loop, whereby the retention loop size is adjustable to the wrist of the hand. The device further may include a second region extending from the first region, wherein the second region is so dimensioned to traverse along the hand between a thumb metacarpal and an index metacarpal of the hand toward a wrist of the hand and has a second end locatable towards the wrist and below a high point of the second region when the first region is held vertical by the hand, wherein the second end of the second region further comprises a low friction material coupled to the second end, wherein friction between a contact region of the elastic section and the second end is reduced. The device further may include a sight pin coupled to the second region proximate to the high point and oriented vertically away from the second region. The device further may include an elastic section coupled to the second end of the second region and having an elastic end, wherein the elastic section is a portion of a hollow elastic tube extending from the first end of the first region and past the second end of the second region to the elastic end, wherein the hollow elastic tube covers the rigid handle, wherein the sight pin is coupled to the hollow elastic tube, wherein the elastic end has a rigid coupler attached to the elastic end and the first string end of the string is coupled to the rigid coupler, wherein the rigid coupler has a hole for attachment of the string, whereby a length of the string extending past the rigid coupler to the loop is adjustable. The device further may include a string having a first string end coupled to the elastic end of the elastic section and having a second string end coupled to a loop so dimensioned for coupling to an archery release, wherein the string is so dimensioned in length to be drawable by an opposite distal hand grasping the archery release when coupled to the loop and when the first region is held by the hand, thereby the elastic section is placeable in tension, wherein the string has a momentum decelerator slidably coupled to the string, whereby the momentum decelerator is slidable along the string.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. An archery training device, comprising:

a rigid handle comprised of:

a first region so dimensioned to fit in a hand between a thumb and an index finger and to be grippable by the hand, wherein the first region has a first end locatable towards a small metacarpal of the hand when the first region is held vertical by the hand; and a second region extending upward from the first region, wherein the second region is so dimensioned to curve so as to traverse along the hand between a thumb metacarpal and an index metacarpal of the hand toward a wrist of the hand and to continue to a second end locatable towards the wrist and below a high point of the curve of the second region when the first region is held vertical by the hand;

a sight pin coupled to the second region proximate to the high point and oriented vertically away from the second region;

an elastic section coupled to the second end of the second region and having an elastic end; and a string having a first string end coupled to the elastic end of the elastic section and having a second string end coupled to a loop so dimensioned for coupling to an archery release, wherein the string is so dimensioned in length to be drawable by an opposite distal hand grasping the archery release when coupled to the loop and when the first region is held by the hand, thereby the elastic section is placeable in tension.

2. The device of claim 1, wherein the rigid handle is comprised of a metal, a plastic, or a composite.

3. The device of claim 2, wherein the rigid handle is comprised of an aluminum alloy.

4. The device of claim 3, wherein the aluminum alloy is a bendable rod.

5. The device of claim 1, wherein the elastic section is a portion of a hollow elastic tube extending from the first end of the first region and past the second end of the second region to the elastic end, wherein the hollow elastic tube covers the rigid handle.

6. The device of claim 5, wherein the hollow elastic tube is an elastomer, a natural rubber, a synthetic rubber, or a silicone elastomer.

7. The device of claim 1, wherein the second end of the second region has a lubricant between the elastic section and the second end, wherein friction between a contact region of the elastic section and the second end is reduced.

8. The device of claim 7, wherein the lubricant is a dry lubricant, a wet lubricant, a synthetic lubricant, a petroleum lubricant, a natural wax, a synthetic wax, a silicon spray lubricant, or a polymeric material.

9. The device of claim 8, wherein the polymeric material includes polytetrafluoroethylene.

10. The device of claim 1, wherein the elastic end has a rigid coupler attached to the elastic end and the first string end of the string is coupled to the rigid coupler, wherein the rigid coupler has a hole for attachment of the string, whereby a length of the string extending past the rigid coupler to the loop is adjustable.

11. The device of claim 1, wherein the string has a momentum decelerator slidably coupled to the string, whereby the momentum decelerator is slidable along the string.

12. The device of claim 1, wherein a retention loop is coupled to the first end of the first region, wherein the retention loop is so dimension to fit around the wrist of the hand, whereby the retention loop allows the device to be securable to the wrist of the hand.

13. The device of claim 12, wherein an adjustment device is slidably coupled to the retention loop to allow adjustment of the size of the retention loop, whereby the retention loop size is adjustable to the wrist of the hand.

14. An archery training device, comprising:

a rigid handle comprised of an ergonomically shaped bendable aluminum alloy rod and is further comprised of:

a first region so dimensioned to fit in a hand between a thumb and an index finger and to be grippable by the hand, wherein the first region has a first end locatable towards a small metacarpal of the hand when the first region is held vertical by the hand, wherein a retention loop is coupled to the first end of the first region, wherein the retention loop is so dimension to fit around the wrist of the hand, whereby the retention loop allows the device to be securable to the wrist of the hand, wherein an adjustment device is slidably coupled to the retention loop to allow adjustment of the size of the retention loop, whereby the retention loop size is adjustable to the wrist of the hand; and a second region extending upward from the first region, wherein the second region is so dimensioned to curve so as to traverse along the hand between a thumb metacarpal and an index metacarpal of the hand toward a wrist of the hand and to continue to a second end locatable towards the wrist and below a high point of the curve of the second region when the first region is held vertical by the hand, wherein the second end of the second region has a lubricant between the elastic section and the second end, wherein friction between a contact region of the elastic section and the second end is reduced;

a sight pin coupled to the second region proximate to the high point and oriented vertically away from the second region;

an elastic section coupled to the second end of the second region and having an elastic end, wherein the elastic section is a portion of a hollow elastic tube extending from the first end of the first region and past the second end of the second region to the elastic end, wherein the hollow elastic tube covers the rigid handle, wherein the elastic end has a rigid coupler attached to the elastic end and the first string end of the string is coupled to the rigid coupler, wherein the rigid coupler has a hole for attachment of the string, whereby a length of the string extending past the rigid coupler to the loop is adjustable; and a string having a first string end coupled to the elastic end of the elastic section and having a second string end coupled to a loop so dimensioned for coupling to an archery release, wherein the string is so dimensioned in length to be drawable by an opposite distal hand grasping the archery release when coupled to the loop and when the first region is held by the hand, thereby the elastic section is placeable in tension, wherein the string has a momentum decelerator slidably coupled to the string, whereby the momentum decelerator is slidable along the string.

* * * * *